US011261588B2

(12) United States Patent
Wu et al.

(10) Patent No.: US 11,261,588 B2
(45) Date of Patent: Mar. 1, 2022

(54) CONNECTION STRUCTURE OF SHOWER COLUMN SYSTEM

(71) Applicant: Purity (Xiamen) Sanitary Ware Co., Ltd., Xiamen (CN)

(72) Inventors: James Wu, Taichung (TW); Alex Wu, Taichung (TW); Ce-Wen Yang, Xiamen (CN); Guo-Zhong Wu, Xiamen (CN); Hai-Kun Zheng, Xiamen (CN)

(73) Assignee: PURITY (XIAMEN) SANITARY WARE CO., LTD., Xiamen (CN)

( * ) Notice: Subject to any disclaimer, the term of this patent is extended or adjusted under 35 U.S.C. 154(b) by 0 days.

(21) Appl. No.: 17/108,245

(22) Filed: Dec. 1, 2020

(65) Prior Publication Data

US 2021/0164201 A1 Jun. 3, 2021

(30) Foreign Application Priority Data

Dec. 2, 2019 (CN) ..... 201922127777.5

(51) Int. Cl.

| | |
|---|---|
| ***E03C 1/04*** | (2006.01) |
| ***A47K 3/28*** | (2006.01) |
| ***E03C 1/06*** | (2006.01) |

(52) U.S. Cl.

CPC ..... *E03C 1/0408* (2013.01); *A47K 3/283* (2013.01); *E03C 1/06* (2013.01); *E03C 2201/30* (2013.01)

(58) Field of Classification Search

CPC ..... E03C 1/0408; E03C 1/06; E03C 2201/30; A47K 3/283

USPC ..... 4/596

See application file for complete search history.

(56) References Cited

U.S. PATENT DOCUMENTS

| | | | | |
|---|---|---|---|---|
| 10,968,612 | B1 * | 4/2021 | Tzeng | E03C 1/0408 |
| 2019/0211537 | A1 * | 7/2019 | Lee | E03C 1/021 |
| 2020/0263399 | A1 * | 8/2020 | Sierks | B05B 1/1618 |
| 2021/0016301 | A1 * | 1/2021 | Cipriani | E03C 1/0408 |
| 2021/0062482 | A1 * | 3/2021 | Dai | B05B 1/18 |

* cited by examiner

*Primary Examiner* — Huyen D Le

(74) *Attorney, Agent, or Firm* — Birch, Stewart, Kolasch & Birch, LLP

(57) ABSTRACT

A connection structure of shower column systems includes fixing member, shower column body having containing cavity, connecting pipe communicating with water supply pipe, and hose in the containing cavity. The shower column body includes installation part having movement channel communicating with the containing cavity; the installation part is installed on the fixing member; the connecting pipe is in wall, an end thereof passes the movement channel to move axially; the hose communicates with water inlet of the shower column body and passes the movement channel to communicate with the connecting pipe. Flexible connection through the hose and connecting pipe makes more adjustment room than rigid connection. Distance between the connecting pipe and shower column body is adjusted by moving the connecting pipe in the movement channel. System adjustment and installation are quickly completed according to different depths of water supply pipes. Sealing performance of products wouldn't be influenced during adjusting.

10 Claims, 4 Drawing Sheets

CONNECTION STRUCTURE OF SHOWER COLUMN SYSTEM

BACKGROUND OF THE INVENTION

1. Technical Field

The present invention relates generally to sanitary ware, and more particularly to a connection structure of a shower column system.

2. Description of Related Art

Recent years, shower column systems are very common in the bathrooms, which include overhead showers, hand-held showers, shower columns (vertical rods), and control valves for adjusting water temperature and water output. Shower column systems would be installed in different ways according to different setting positions of the water supply pipes. For example, for connecting an in-wall water supply pipe, a shower column has to be combined with a connection structure which penetrates into the wall and is connected to the water supply pipe. Moreover, for adapting to different setting depths of the water supply pipe (distances from the wall), the connection structure is designed as an adjustable structure so that the distance between the water inlet of the shower column and the water outlet of the water supply pipe can be adjusted. In the existing connection structure of the shower column system, a connecter penetrates into the wall and is connected to the water supply pipe by one end thereof, while the other end of the connecter is movably connected to one end of a support, wherein the other end of the support fits around the shower column. The distance between the shower column and the connecter can be adjusted by changing the cooperating depth between the support and the connecter. In this way, the shower column can be installed according to different setting depths of the water supply pipe.

However, the sealing performance between the support and the connecter is improved through a sealing member which inevitably generates friction and resistance during the adjustment process for the support and the connecter. Accordingly, the adjustment process could be laborious and time-consuming. Additionally, the sealing member may be worn by the friction, which will eventually reduce the sealing performance of products.

BRIEF SUMMARY OF THE INVENTION

In view of the above, the primary objective of the present invention is to provide a connection structure of a shower column system, which can quickly complete the adjustment and installation of the shower column system according to different setting depths of the water supply pipes, as well as can ensure the sealing performance of products.

The present invention provides a connection structure of a shower column system, which includes a fixing member which is provided on a wall, a shower column body, a connecting pipe which has one end communicating with a water supply pipe, and a hose; the shower column body has a containing cavity and further includes an installation part, wherein the installation part has a movement channel which communicates with the containing cavity; a top end of the installation part is installed on the fixing member; the connecting pipe is provided in the wall; another end of the connecting pipe passes in the movement channel to axially move within the movement channel; the hose is located in the containing cavity, wherein the hose has one end which communicates with a water inlet of the shower column body; the hose further has another end which passes in the movement channel to communicate with the another end of the connecting pipe.

Wherein the connecting pipe and the movement channel are matched with a clearance therebetween.

Wherein the connection structure of the shower column system further includes a connecter which has two ends which respectively communicate with the hose and the connecting pipe.

Wherein the connection structure of the shower column system further includes a tying member which fits around and tightly presses the hose and the connecter at a junction of the hose and the connecter.

Wherein the connection structure of the shower column system further includes a sealing member which is disposed between the connecter and the connecting pipe so as to ensure a sealing effect.

Wherein the connection structure of the shower column system further includes a sleeve which fits around a periphery of the installation part and is connected to the fixing member.

Wherein the fixing member has a protrusion; a periphery of the protrusion is provided with an external thread, and an inner side of one end of the sleeve is provided with an internal thread which matches the external thread, so that the fixing member matches the sleeve through threads.

Wherein the fixing member has a mounting hole; another end of the installation part inserts into the mounting hole.

Wherein the shower column body includes a support, an upper pipe for supplying water to a top nozzle, and a lower pipe; one end of the support is the installation part, and another end of the support is a ring section; the upper pipe and the lower pipe are connected to an upper end and a lower end of the ring section respectively; the containing cavity is provided within the lower pipe.

Wherein the hose is made of PVC.

The present invention a flexible connection between the shower column body and the water supply pipe is realized by the hose and the connecting pipe, which makes more room for adjustment than a rigid connection. Moreover, the distance between the connecting pipe and the shower column body can be adjusted by the movement of the connecting pipe in the movement channel. In this way, the adjustment and installation of the shower column system can be quickly completed according to different setting depths of the water supply pipes. Additionally, the sealing performance of the hose and the connecting pipe would not be influenced during the adjustment process, so that the sealing performance of products can be ensured.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
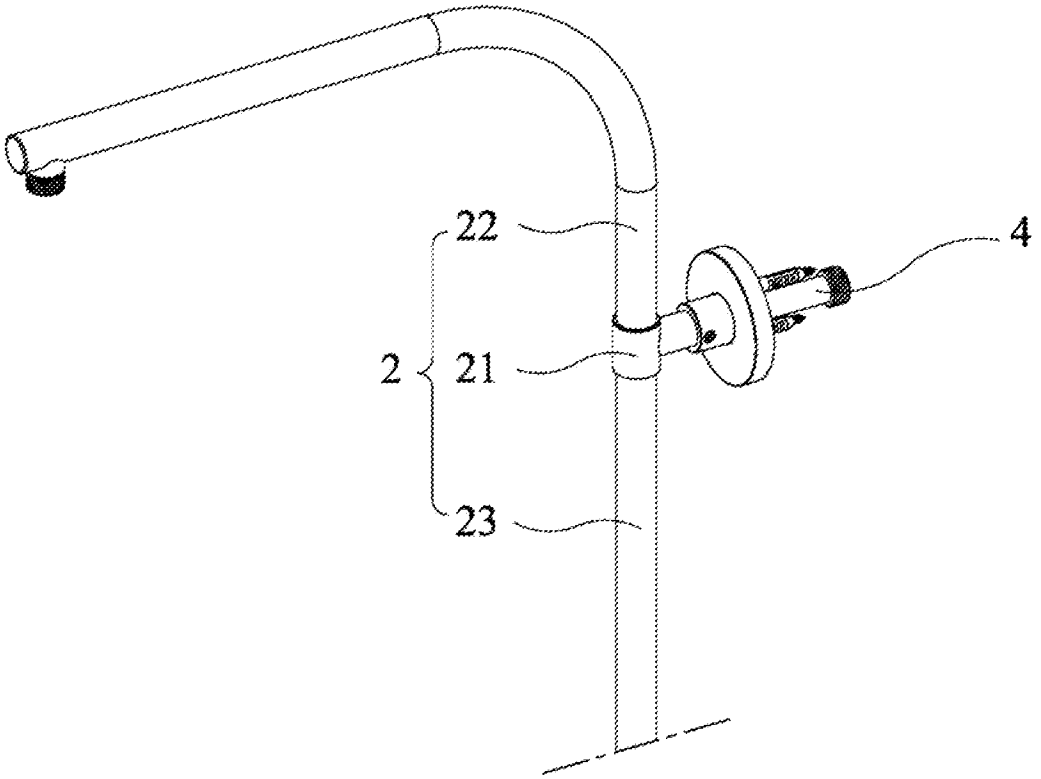
FIG. 1 is a perspective view of the first embodiment of the present invention.

A first embodiment of the present invention, a connection structure of a shower column system includes a fixing member 1 that is installed on a wall, a shower column body 2, a connecting pipe 3 whose one end is connected to a water supply pipe (not shown), and a hose 4.

The shower column body 2 has a containing cavity 231 and further includes an installation part 211 which have a movement channel 2111 communicating with the containing cavity 231, wherein a top end of the installation part 211 is installed on the fixing member 1.

The connecting pipe 3 is installed in the wall, and the other end thereof passes in the movement channel 2111 to axially move within the movement channel 2111.

The hose 4 is located in the containing cavity 231. One end of the hose 4 communicates with a water inlet of the shower column body 2, and the other end of the hose 4 passes in the movement channel 2111 to communicate with the other end of the connecting pipe 3.

Figure 2:
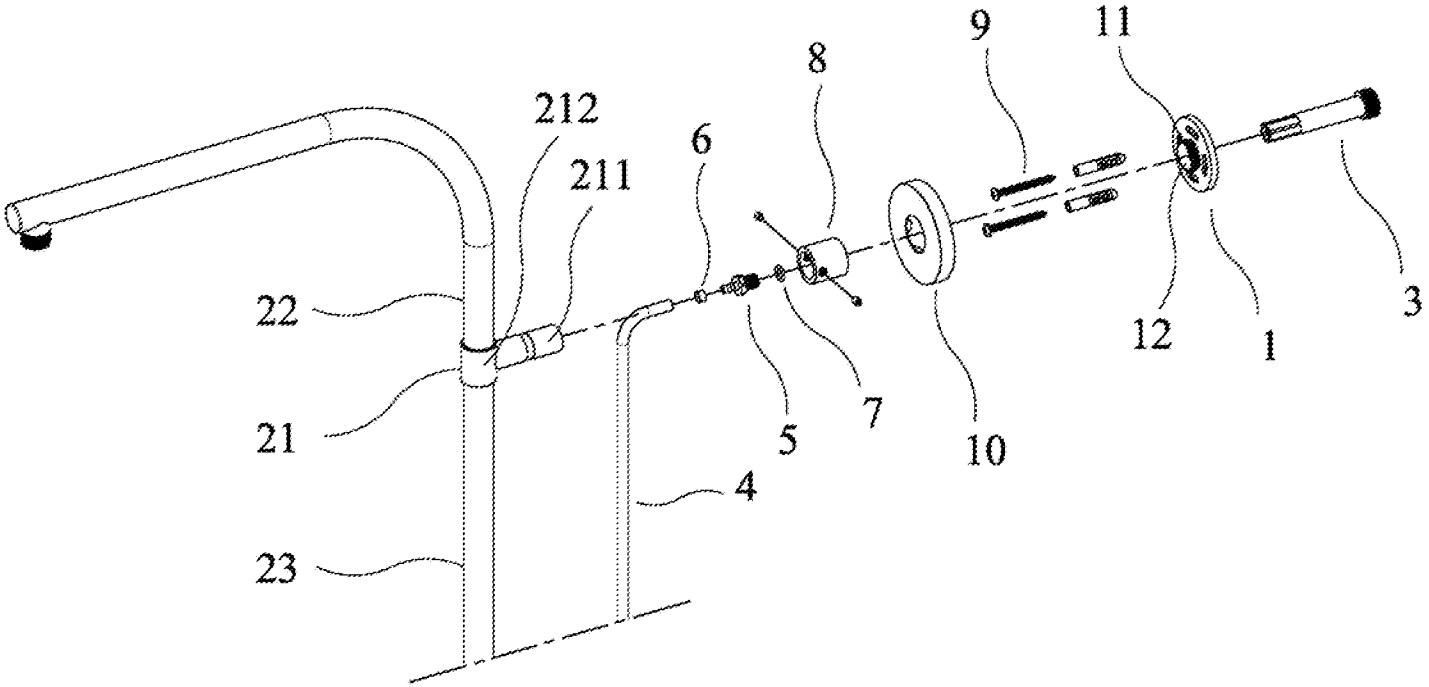
FIG. 2 is an exploded view of the first embodiment.
Figure 3:
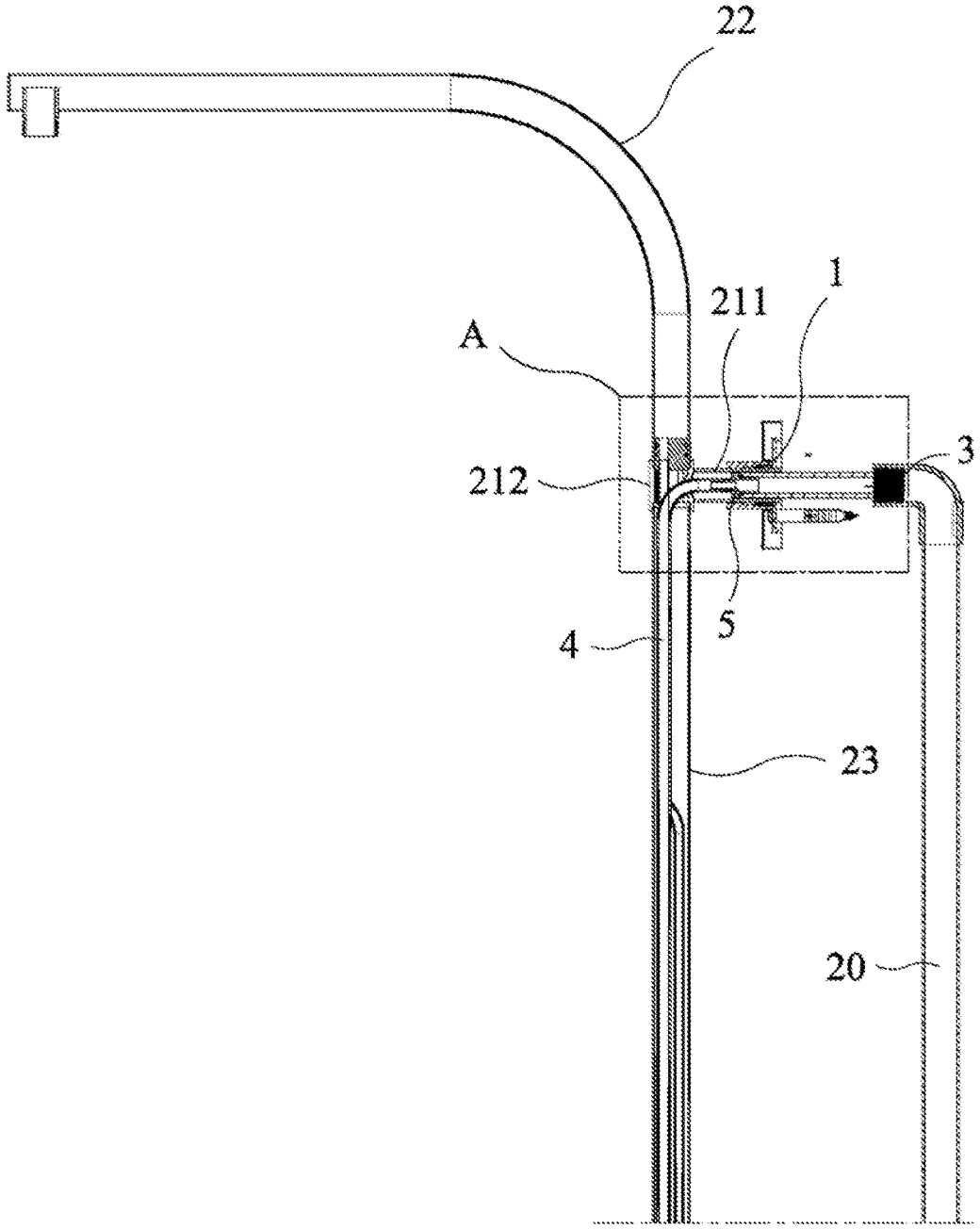
FIG. 3 is a sectional view of the first embodiment.
Figure 4:
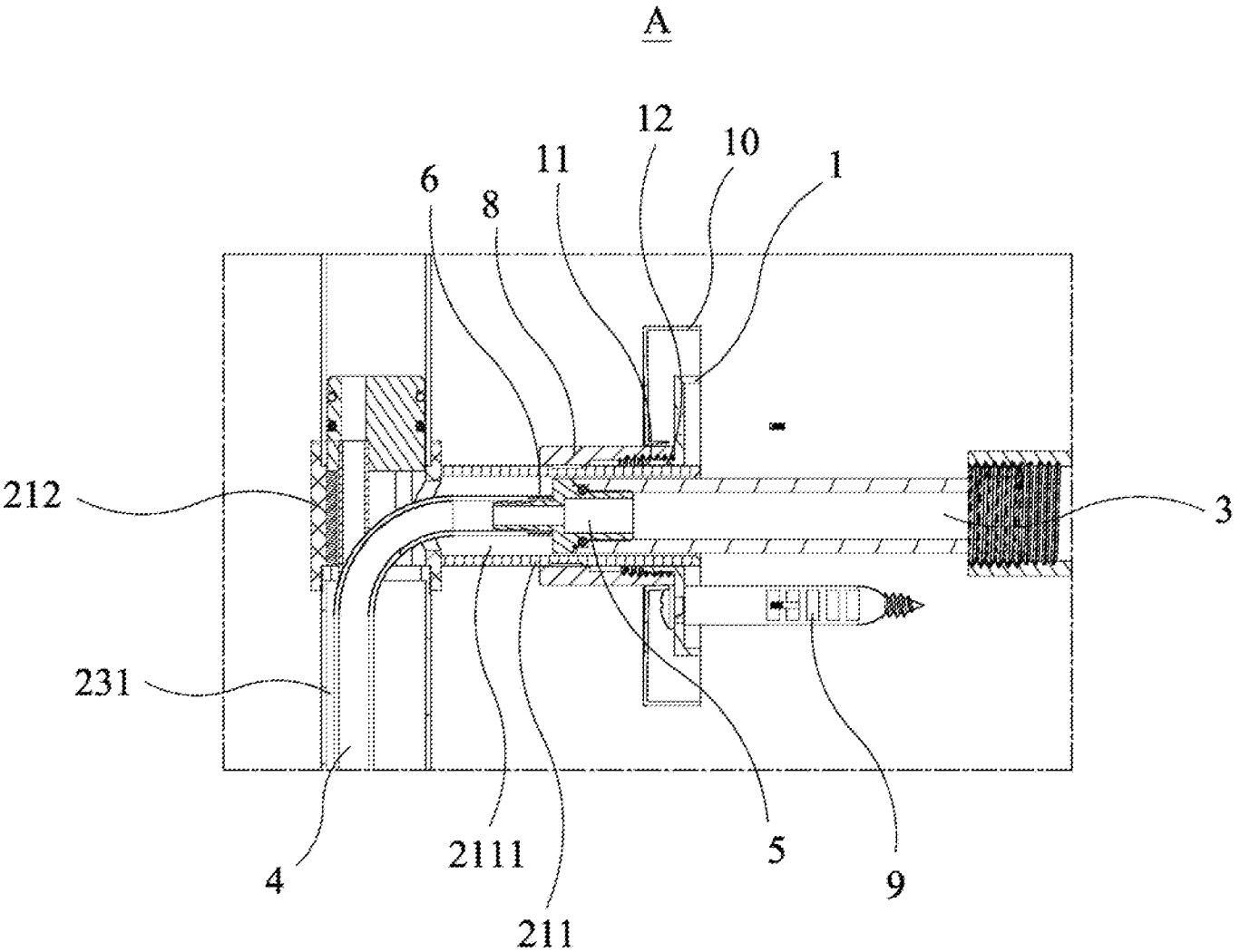
FIG. 4 is an enlarged view of the region A in FIG. 3.

Referring to FIG. 1 to FIG. 4, the first embodiment of the present invention is shown specifically.

The connecting pipe 3 and the movement channel 2111 are matched with a clearance therebetween.

This embodiment further includes a connecter 5 which connects the hose 4 and the connecting pipe 3 with two ends thereof respectively.

This embodiment further includes a tying member 6 which fits around and tightly presses the hose 4 and the connecter 5 at the junction of the hose 4 and the connecter 5 so as to firm up their installation. That is, the tying member 6 prevents the hose 4 from detaching from the connector 5 due to sway, and accordingly improves the sealing effect at the junction of the hose 4 and the connecter 5.

This embodiment further includes a sealing member 7 which is disposed between the connecter 5 and the connecting pipe 3 so as to ensure the sealing effect at the junction of the connecter 5 and the connecting pipe 3.

This embodiment further includes a sleeve 8 which fits around the periphery of the installation part 211 and is connected to the fixing member 1.

The fixing member 1 has a protrusion 11, and the periphery of the protrusion 11 is provided with an external thread (not shown). The inner side of one end of the sleeve 8 is provided with an internal thread (not shown) that matches the external thread so that the fixing member 1 is screwed onto the sleeve 8 through threads.

The fixing member 1 has a mounting hole 12, wherein another end of the installation part 211 inserts into the mounting hole 12.

The fixing member 1 is fixed on the wall through an expansion screw 9.

This embodiment further includes a modifying cover 10 which covers the fixing member 1 to cover up the expansion screw 9 so that the expansion screw 9 is dustproof and waterproof. In addition, the connection structure has a simple appearance accordingly.

The shower column body 2 includes a support 21, an upper pipe 22 for supplying water to a top nozzle, and a lower pipe 23. One end of the support 21 is the installation part 211, and the other end of the support 21 is a ring section 212, wherein the upper pipe 22 and the lower pipe 23 are connected to an upper end and a lower end of the ring section 212 respectively. The containing cavity 231 is provided within the lower pipe 23.

The hose 4 is made of PVC (polyvinyl chloride).

With the abovementioned structure, a flexible connection between the shower column body 2 and the water supply pipe is realized by the hose 4 and the connecting pipe 3, which makes more room for adjustment than a rigid connection. Moreover, the distance between the connecting pipe 3 and the shower column body 2 can be adjusted by the movement of the connecting pipe 3 in the movement channel 2111. In this way, the adjustment and installation of the shower column system can be quickly completed according to different setting depths of the water supply pipes. Additionally, the sealing performance of the hose 4 and the connecting pipe 3 would not be influenced during the adjustment process, so that the sealing performance of products can be ensured.

It must be noted that the embodiments described above are only preferred embodiments of the present invention. All equivalent structures which employ the concepts disclosed in this specification and the appended claims should fall within the scope of the present invention.

What is claimed is:

1. A connection structure of a shower column system, comprising:

a fixing member which is provided on a wall;

a shower column body which has a containing cavity and further comprises an installation part, wherein the installation part has a movement channel which communicates with the containing cavity; a top end of the installation part is installed on the fixing member;

a connecting pipe which has one end communicating with a water supply pipe, wherein the connecting pipe is provided in the wall; another end of the connecting pipe passes in the movement channel to axially move within the movement channel; and a hose which is located in the containing cavity, wherein the hose has one end which communicates with a water inlet of the shower column body; the hose further has another end which passes in the movement channel to communicate with the another end of the connecting pipe.

2. The connection structure of claim 1, wherein the connecting pipe and the movement channel are matched with a clearance therebetween.

3. The connection structure of claim 1, further comprising a connecter which has two ends which respectively communicate with the hose and the connecting pipe.

4. The connection structure of claim 3, further comprising a tying member which fits around and tightly presses the hose and the connecter at a junction of the hose and the connecter.

5. The connection structure of claim 3, further comprising a sealing member which is disposed between the connecter and the connecting pipe so as to ensure a sealing effect.

6. The connection structure of claim 1, further comprising a sleeve which fits around a periphery of the installation part and is connected to the fixing member.

7. The connection structure of claim 6, wherein the fixing member has a protrusion; a periphery of the protrusion is provided with an external thread, and an inner side of one end of the sleeve is provided with an internal thread which matches the external thread, so that the fixing member matches the sleeve through threads.

8. The connection structure of claim 1, wherein the fixing member has a mounting hole; another end of the installation part inserts into the mounting hole.

9. The connection structure of claim 1, wherein the shower column body comprises a support, an upper pipe for supplying water to a top nozzle, and a lower pipe; one end of the support is the installation part, and another end of the support is a ring section; the upper pipe and the lower pipe are connected to an upper end and a lower end of the ring section respectively; the containing cavity is provided within the lower pipe.

10. The connection structure of claim 1, wherein the hose is made of PVC.

* * * * *